US008172550B2

(12) United States Patent
Ji

(10) Patent No.: US 8,172,550 B2
(45) Date of Patent: May 8, 2012

(54) VACUUM SELF PRIMING PUMP

(76) Inventor: Hyokeun Ji, Seoul (KR)

( * ) Notice: Subject to any disclaimer, the term of this patent is extended or adjusted under 35 U.S.C. 154(b) by 353 days.

(21) Appl. No.: 12/618,853

(22) Filed: Nov. 16, 2009

(65) Prior Publication Data

US 2010/0303651 A1 Dec. 2, 2010

(30) Foreign Application Priority Data

May 29, 2009 (KR) ..... 10-2009-0047493

(51) Int. Cl.
*F04B 23/08* (2006.01)

(52) U.S. Cl. ..... 417/199.2; 417/223; 417/319; 192/89.27; 192/101

(58) Field of Classification Search ..... 417/223, 417/319, 199.1–202; 192/69, 69.82, 89.27, 192/101
See application file for complete search history.

(56) References Cited

U.S. PATENT DOCUMENTS

| | | | | | |
|---|---|---|---|---|---|
| 962,567 | A | * | 6/1910 | Hancock | |
| 1,597,198 | A | * | 8/1926 | Neverson | 192/69.81 |
| 1,984,667 | A | * | 12/1934 | Watson | 417/211.5 |
| 2,361,086 | A | * | 10/1944 | Carlson | 417/15 |
| 2,384,172 | A | * | 9/1945 | Fort et al. | 417/200 |
| 2,412,839 | A | * | 12/1946 | Smith | 417/202 |
| 3,316,850 | A | * | 5/1967 | Roberts et al. | 417/201 |

* cited by examiner

*Primary Examiner* — Charles Freay
*Assistant Examiner* — Thomas Fink
(74) *Attorney, Agent, or Firm* — Kile Park Goekjian Reed & McManus PLLC

(57) ABSTRACT

Provided is a vacuum self priming pump. The pump includes an actuating member that is installed in an outlet by a hinge shaft to be capable of rotating and configured to be quickly opened by water pressure when water is discharged through the outlet, an arm that extends from the actuating member to an external side over the outlet, a clutch unit that is movably formed in a length direction of a rotational shaft of a motor to selectively transfer power to an eccentric wheel to free-rotate the eccentric wheel on the rotational shaft, and a transferring unit that is installed between the arm and the clutch unit to cut off the power from the clutch unit to the eccentric wheel when the arm moves.

6 Claims, 6 Drawing Sheets

VACUUM SELF PRIMING PUMP

CROSS-REFERENCE TO RELATED APPLICATION

This application claims priority to Korean Patent Application No. 10-2009-047493filed on May 29, 2009 and all the benefits accruing therefrom under 35 U.S.C. §119, the contents of which are incorporated by reference in their entirety.

BACKGROUND

The present disclosure relates to a vacuum self priming pump used for pumping out water from the reservoir or dam.

Generally, a pump is used to pump out water from the reservoir, damp, flood areas, and the like. A vacuum self priming pump using air suction of diaphragm is usually used as the pump.

The vacuum self priming pump is disclosed in Korean Patent No. 0791044 to an applicant of this application. FIG. 6 shows the vacuum self priming pump disclosed in the Korean Patent. As shown in FIG. 6, the vacuum self priming pump includes a motor 50, an impeller 51 rotating by the motor 50, a body 56 for receiving the impeller 51 and provided with fluid inlet and outlet 53 and 55 and an air exhaust tube 54, and a diaphragm 57 that is installed to suck air into the body 56 through the air exhaust tube 54.

The diaphragm 57 operates by a rotational shaft 58 of the motor 50. The diaphragm 57 includes an eccentric wheel 59 that is eccentrically installed on the rotational shaft 58 to free-rotate, a rotational ring 60 that is coupled to an outer circumference to allow the pumping motion of the diaphragm 57 by the rotation of the eccentric wheel 59, and an electronic clutch 61 that is installed to connect or disconnect torque of the rotational shaft 58 to the eccentric wheel 59.

In addition, buoy 62 and a check valve 63 are installed on the air exhaust tube 54 to close the air exhaust tuber 54 when the air is introduced into the body 56 of the diaphragm 57 and thus the fluid level increases. In addition, a sensor 64 and a control unit are provided to cut off the power to the diaphragm 57 by operating the electron clutch 61 when the air exhaust tube 54 is closed.

The following will describe the operation of the above-described pump. When the motor 50 operates, the impeller 51 operates b the rotation of the rotational shaft 58 and the electronic clutch 61 transfers the power to the eccentric wheel 59. Therefore, the diaphragm 57 does the pumping operation by the eccentric wheel 59 and the rotational ring 60.

When the diaphragm 57 starts the pumping operation, the air in the body 56 is discharged through the air exhaust tube 54 to form a vacuum state. In this vacuum state, the fluid is introduced into the body 56 through the fluid inlet 53. Then, the fluid is pumped out through the fluid outlet 55 by the impeller 51 at predetermined pressure.

Particularly, when the check valve 63 is closed, the sensor 64 detects the same and transfers a corresponding signal to the control unit. Then, the control unit operates the electronic clutch 61 to cut off the power transferred to the eccentric wheel 59 to stop the operation of the diaphragm 57.

In order to stop the operation of the diaphragm as the check valve installed on the air exhaust tube after the fluid is pumped out, the sensor must be installed on the buoy and the control unit must be proved. In addition, in order to cut off or transfer the power, the electronic clutch that is expensive must be installed. These cause the cost of the pump to increase.

That is, the pump that is a mechanical device is electronically controlled, the number of components increases and thus the manufacturing cost increase.

Furthermore, since the sensor, control unit, and electronic clutch are all electronic components that are vulnerable to moisture, there are easily frequently broken when they are applied to the pump handling the fluid.

SUMMARY

The present disclosure provides a vacuum self priming pump that is configured to reduce the manufacturing cost and improve the reliability by preventing the malfunctioning thereof in advance.

In accordance with an exemplary embodiment, a vacuum self priming pump includes a motor; an impeller rotating by the motor; a body for receiving the impeller and provided with fluid inlet and outlet and an air exhaust tube; and a diaphragm that is installed to suck air into the body through the air exhaust tube, wherein the vacuum self priming pump further includes an actuating member that is installed in an outlet by a hinge shaft to be capable of rotating and configured to be quickly opened by water pressure when water is discharged through the outlet; an arm that extends from the actuating member to an external side over the outlet; a clutch unit that is movably formed in a length direction of a rotational shaft of a motor to selectively transfer power to an eccentric wheel to free-rotate the eccentric wheel on the rotational shaft; and a transferring unit that is installed between the arm and the clutch unit to cut off the power from the clutch unit to the eccentric wheel when the arm moves.

The clutch unit may include a clutch member that is coupled to a plurality of sliding grooves that are formed on the rotational shaft of the motor in the length direction of the rotational shaft to be capable of moving in the length direction and provided with a first gear toward the eccentric wheel; a second gear that is formed on the eccentric wheel and selectively engaged with the first gear to selectively transfer the power; and an elastic unit that is installed between an eccentric wheel housing and the clutch member to apply elastic force in a direction where the first and second gears are engaged with each other.

The transferring unit may include a ring member that is securely rotatably inserted in a rotational groove formed on a surface of the clutch member; and a wire having a first end connected to the arm and a second end connected to the ring member.

The vacuum self priming pump may further include a plurality of guide rollers that guide the wire to enhance power transferring by the arm.

The elastic unit may include a return spring that is installed between the housing and the clutch member to bias the clutch member toward the eccentric wheel.

The vacuum self priming pump may further include a sealing member that is disposed between the arm and the outlet to prevent leakage of the water to an external side and minimize interference of actuation of the arm.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
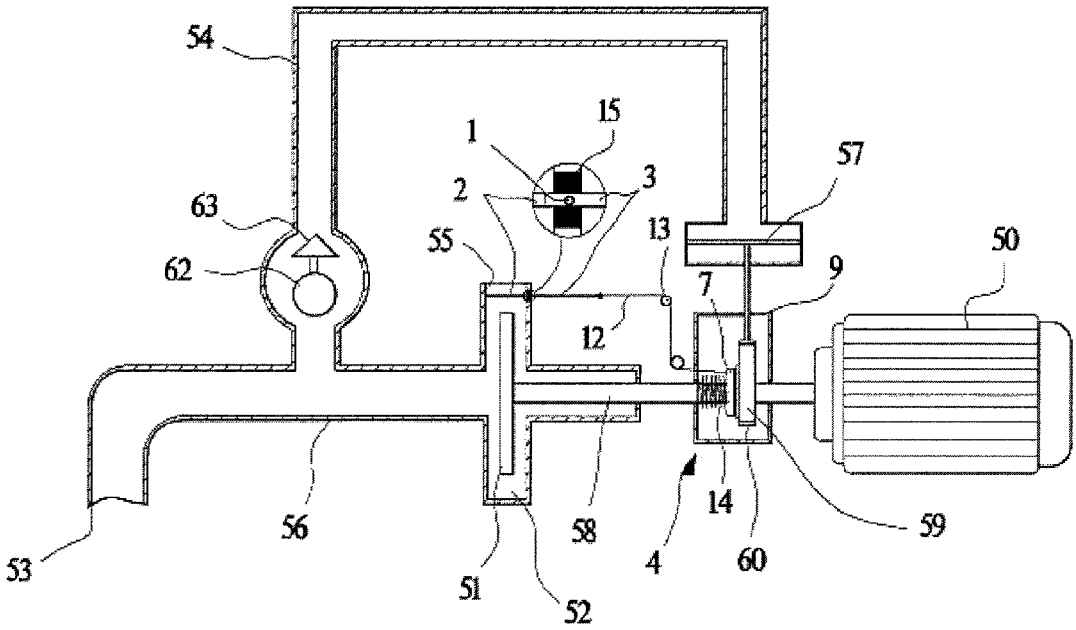
FIG. 1 is a schematic view of a vacuum self priming pump according to an exemplary embodiment.

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

In the figures, the dimensions of layers and regions are exaggerated for clarity of illustration. Like reference numerals refer to like elements throughout.

Figure 2:
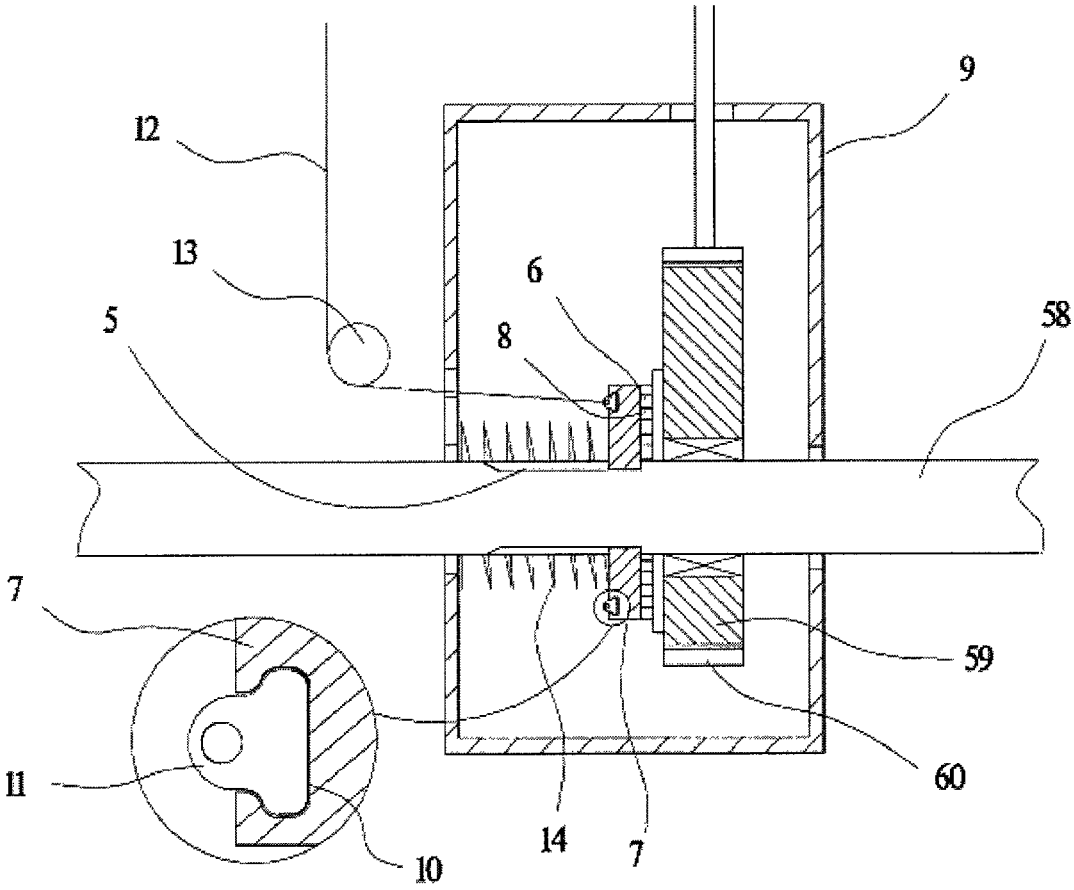
FIG. 2 is a partially enlarged cross-sectional view of a clutch unit of FIG. 1.
Figure 3:
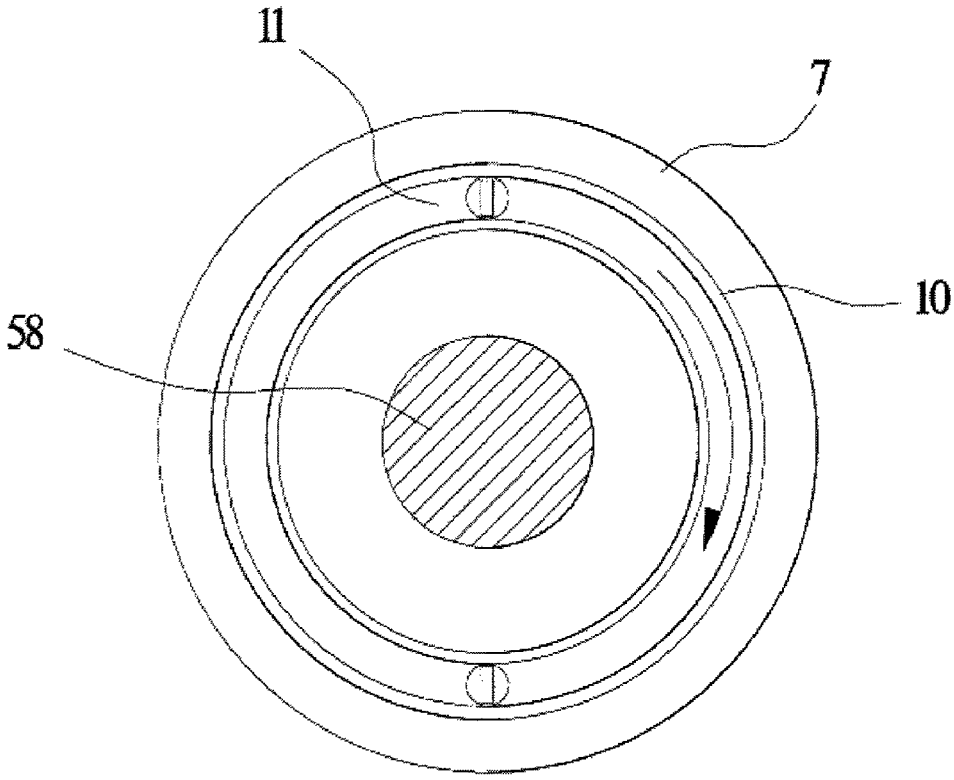
FIG. 3 is a top plane view illustrating a ring member installed on a clutch member of FIG. 2.
Figure 4:
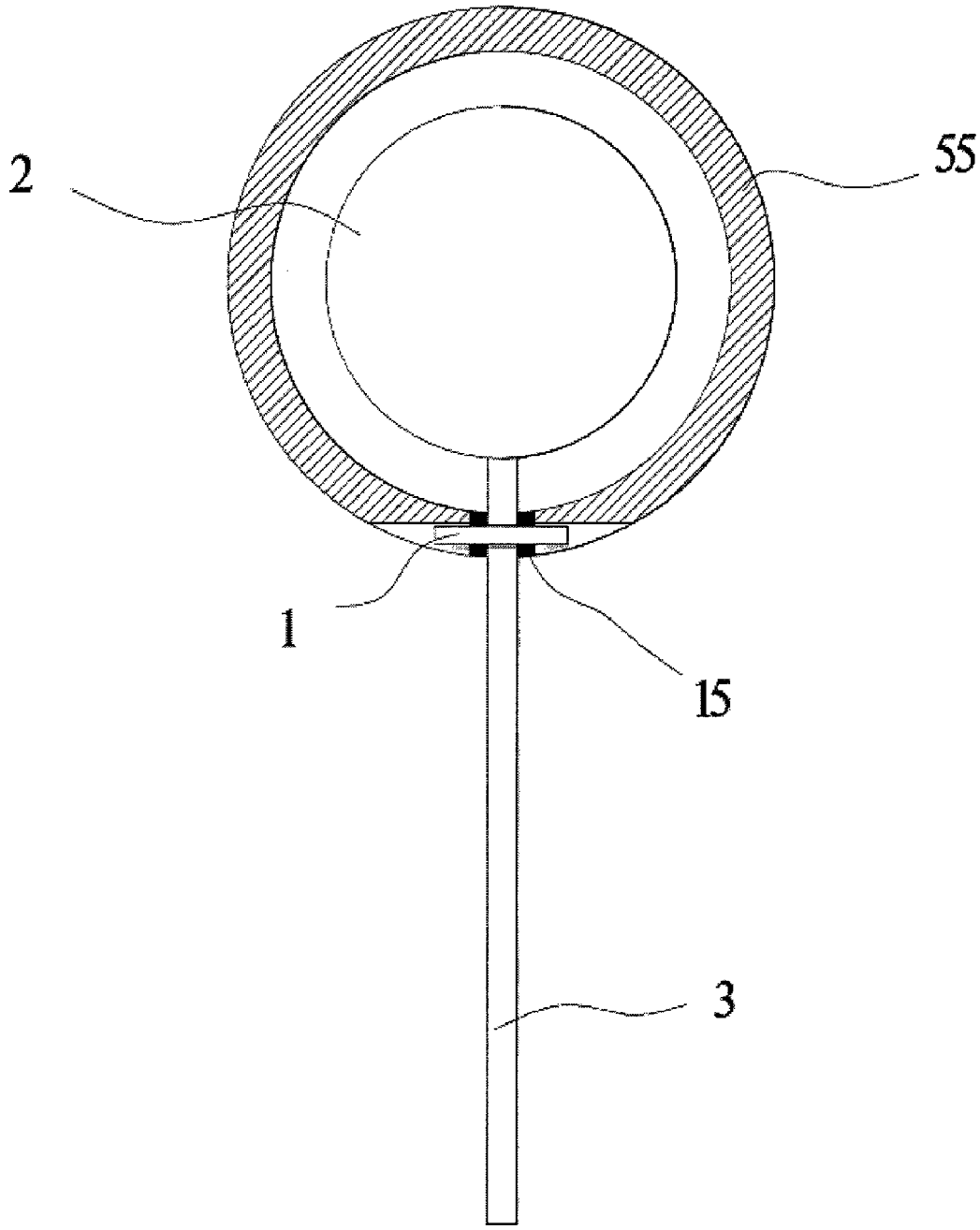
FIG. 4 is a top sectional view illustrating an installing state of an arm of FIG. 1.

FIG. 1 is a schematic view of a vacuum self priming pump according to an exemplary embodiment, FIG. 2 is a partially enlarged cross-sectional view of a clutch unit of FIG. 1, FIG. 3 is a top plane view illustrating a ring member installed on a clutch member of FIG. 2, and FIG. 4 is a top sectional view illustrating an installing state of an arm of FIG. 1.

A vacuum self priming pump according to an exemplary embodiment includes an actuating member 2 that is installed in an outlet 55 by a hinge shaft 1 to be capable of rotating and configured to be quickly opened by water pressure when water is discharged through the outlet 55, an arm 3 that extends from the actuating member 2 to an external side over the outlet 55, a clutch unit 4 that is movably formed in a length direction of a rotational shaft of a motor 50 to selectively transfer power to an eccentric wheel 59 to free-rotate the eccentric wheel 59 on the rotational shaft 58, and a transfer-ring unit that is installed between the arm 3 and the clutch unit 4 to cut off the power from the clutch unit 4 to the eccentric wheel 59 when the arm 3 moves.

That is, when the water is discharged through the outlet 55 with high pressure, the actuating member 2 is opened based on the hinge shaft 1. Then, the arm 3 extending from the actuating member 2 moves in an opposite direction to the actuating member 2 and thus the clutch unit 4 actuates to cut off the power applied to the eccentric wheel 59.

The clutch unit 4 includes a clutch member 7 that is coupled to a plurality of sliding grooves 5 that are formed on the rotational shaft 58 of the motor 50 in the length direction of the rotational shaft 58 to be capable of moving in the length direction and provided with a first gear 6 toward the eccentric wheel 59, a second gear 8 that is formed on the eccentric wheel 59 and selectively engaged with the first gear 6 to selectively transfer the power, and an elastic unit that is installed between an eccentric wheel housing 9 and the clutch member 7 to apply elastic force in a direction where the first and second gears 6 and 8 are engaged with each other.

The transferring unit includes a ring member 11 that is securely rotatably inserted in a rotational groove formed on a surface of the clutch member 7 and a wire 12 having a first end connected to the arm 3 and a second end connected to the ring member 11. When the wire 12 is pulled by the arm 3, the ring member 11 and the clutch member 7 that are connected to the wire 12 are pulled and thus the power transferring to the eccentric wheel 59 is cut off.

Needless to say, when the clutch member 7 rotates, the ring member 11 maintains a stationary state in the rotational groove 10. Therefore, when a bearing (not shown) is installed between the rotational groove 10 and the ring member 11, the clutch member 7 can more smoothly rotate.

In addition, a plurality of guide rollers 13 may be provided so that the power transferring by the arm 3 can be more effectively realized by guiding the wire 12.

The elastic unit may be a return spring 14 through which the rotational shaft 58 of the motor is installed and which is installed between the housing 9 and the clutch member 7 to bias the clutch member 7 toward the eccentric wheel 59.

Here, as shown in FIGS. 1 and 4, disposed between the arm 3 and the outlet 55 is a sealing member 15 that can prevent the leakage of the water to an external side and minimize the interference of the actuation of the arm 3.

The following will describe the operational effect of the above-describe pump.

When the motor 50 operates, the rotational shaft 58 rotates at a high speed and the clutch member 7 coupled to the sliding grooves 5 of the rotational shaft 58 rotates together.

When the clutch member 7 rotates, the eccentric wheel 59 engaged with the clutch member 7 by the first and second gears 6 and 8 rotates and thus the rotational ring 60 coupled to the eccentric wheel 59 reciprocates, as a result of which the diaphragm 57 connected to the rotational ring 60 starts the pumping operation.

When the diaphragm 57 starts pumping, the air is discharged out of the body 56 through an air exhaust tube 54 to vacuum the inside of the body 56 and the water is introduced into the body through the inlet 53. Therefore, the inside of the body 56 is filled with the water.

As the water is filled in the body 56, the buoy 62 installed on the air exhaust tube 54 gradually ascends to allow the check valve 63 closes the air exhaust tube 54.

When the air exhaust tube 54 is closed by the check valve 63, the water is strongly sucked by the impeller 51 to push the actuating member 2 installed on the outlet 55. Then, the actuating member 2 rotates about the hinge shaft 1 by the water pressure to a state shown in FIG. 5.

Figure 5:
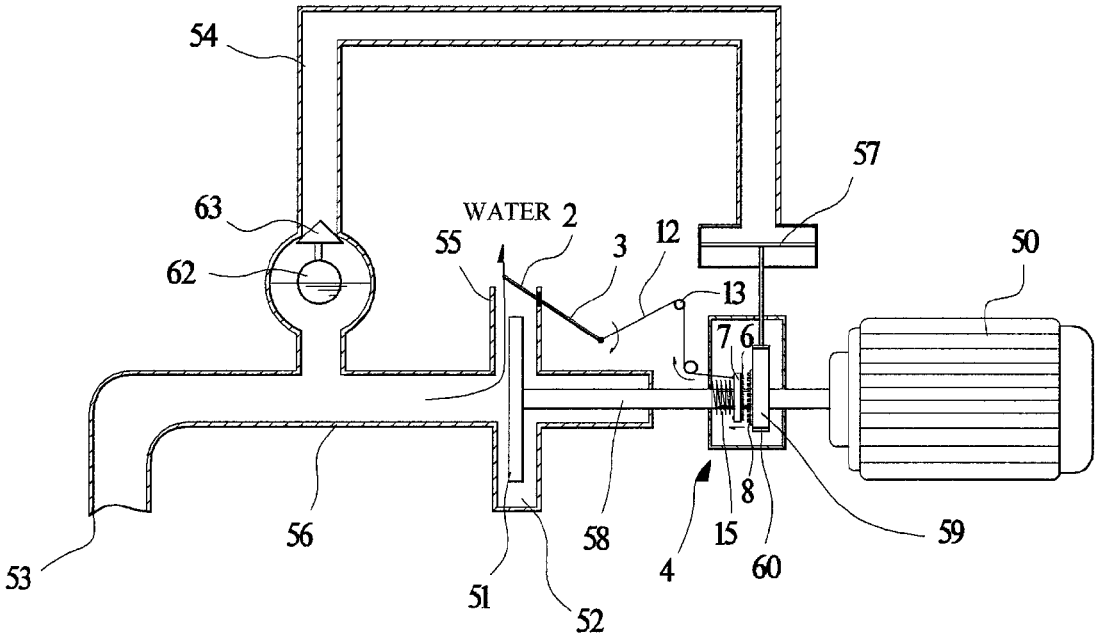
FIG. 5 is a schematic view illustrating a state where an air exhaust tube is closed and water is discharged through a fluid outlet tube.
Figure 6:
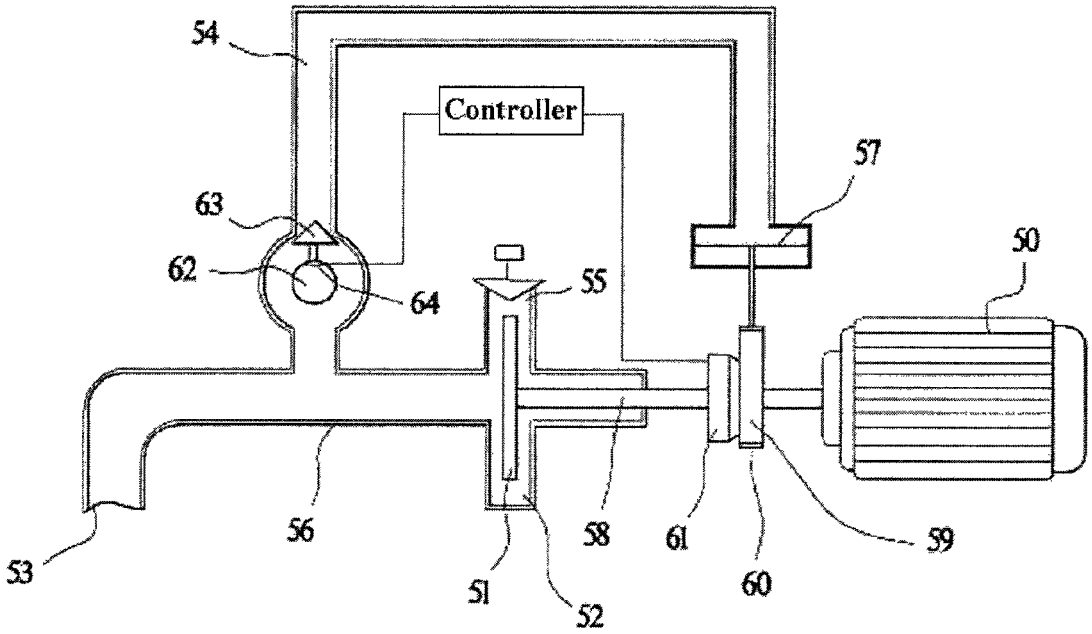
Fig. 6 Prior Art
FIG. 6 is a schematic view of a vacuum self priming pump of a related art.

When the actuating member 2 is abruptly opened by the water pressure as shown in FIG. 5, the arm 3 connected to the actuating member 2 strongly rotates clockwise and thus the wire 12 connected to the arm 3 is strongly pulled.

When the wire 12 is pulled, the clutch member 7 connected to the second end of the wire 12 is pulled and thus the first gear 6 of the clutch member 7 is disengaged with the second gear 8 of the eccentric wheel 59 to cut off the power of the eccentric wheel 59.

At this point, although the clutch member 7 is in a rotating state, the ring member 11 connected to the wire 12 is stationary in the rotational groove 10 of the clutch member 7. Therefore, the wire 12 connected to the ring member 11 pulls the ring member 11 and thus the ring member 11 maintains the stationary state regardless of the rotation of the clutch member 7.

When the power of the eccentric wheel 59 is cut off, the diaphragm 57 stops operation not to perform the pumping operation any more.

When the power of the eccentric is cut off, the operation of the diaphragm 57 stops and no pumping operation is done any more. Therefore, the operation stoppers at the moment the water is sucked and the energy loss can be reduced.

In addition, the clutch member 7 moves along the sliding groove 5 formed on the rotational shaft 58 when it is pulled by the wire 12 to compress the return spring 14 with predetermined force.

When the clutch member 7 is spaced apart from the eccentric wheel 59, the water is sucked and discharged through the outlet 55. Therefore, when the motor 50 stops to stop the sucking of the water, the impeller 51 stops operating.

When the impeller 51 stops operating, the water pressure is released and the actuating member 2 cannot be ascended. At this point, the clutch member 7 is pushed again by the return spring 14 to be engaged with the eccentric wheel 59.

The water is not sucked when the clutch member 7 is engaged with the eccentric wheel 59 by the first and second gears 6 and 8. Therefore, when the motor operates again, the water is sucked through the above-described process.

According to the exemplary embodiment, since the actuating member, wire, and clutch unit are installed such that the power applied to the diaphragm is cut off by the water that is quickly discharged through the outlet when the check valve of the air exhaust tube is closed by the water sucked into the body by the air discharged out of the air from the body, the structure of the vacuum self priming pump can be simplified. In addition, since the control unit, second, electronic clutch that are expensive are not used, the manufacturing cost can be significantly reduced.

Although the vacuum self priming pump has been described with reference to the specific embodiments, it is not limited thereto. Therefore, it will be readily understood by those skilled in the art that various modifications and changes can be made thereto without departing from the spirit and scope of the present invention defined by the appended claims.

What is claimed is:

1. A vacuum self priming pump comprising: a motor; an impeller rotated by the motor; a body for receiving the impeller and provided with a fluid inlet and outlet and an air exhaust tube; and a diaphragm that is installed to suck air into the body through the air exhaust tube, wherein the vacuum self priming pump further comprises: an actuating member that is installed in an outlet by a hinge shaft to be capable of rotating and configured to be quickly opened by water pressure when water is discharged through the outlet; an arm that extends from the actuating member to an external side over the outlet; a clutch unit that is movably formed in a length direction of a rotational shaft of a motor to selectively transfer power to an eccentric wheel to free-rotate the eccentric wheel on the rotational shaft; and a mechanical transferring unit that is installed between the arm and the clutch unit to cut off the power from the clutch unit to the eccentric wheel when the arm moves.

2. The vacuum self priming pump of claim 1, wherein the clutch unit comprises:

a clutch member that is coupled to a plurality of sliding grooves that are formed on the rotational shaft of the motor in the length direction of the rotational shaft to be capable of moving in the length direction and provided with a first gear toward the eccentric wheel;

a second gear that is formed on the eccentric wheel and selectively engaged with the first gear to selectively transfer the power; and an elastic unit that is installed between an eccentric wheel housing and the clutch member to apply elastic force in a direction where the first and second gears are engaged with each other.

3. The vacuum self priming pump of claim 1, wherein the transferring unit comprises:

a ring member that is securely rotatably inserted in a rotational groove formed on a surface of the clutch member; and a wire having a first end connected to the arm and a second end connected to the ring member.

4. The vacuum self priming pump of claim 3, further comprising a plurality of guide rollers that guide the wire to enhance power transferring by the arm.

5. The vacuum self priming pump of claim 2, wherein the elastic unit includes a return spring that is installed between the housing and the clutch member to bias the clutch member toward the eccentric wheel.

6. The vacuum self priming pump of claim 1, further comprising a sealing member that is disposed between the arm and the outlet to prevent leakage of the water to an external side and minimize interference of actuation of the arm.

* * * * *